US009267332B2

(12) United States Patent
Rupp et al.

(10) Patent No.: US 9,267,332 B2
(45) Date of Patent: Feb. 23, 2016

(54) IMPREGNATED DRILLING TOOLS INCLUDING ELONGATED STRUCTURES

(75) Inventors: Michael D. Rupp, Murray, UT (US); Cody A. Pearce, Midvale, UT (US); Christian M. Lambert, Draper, UT (US); Kristian S. Drivdahl, Park City, UT (US)

(73) Assignee: LONGYEAR TM, INC., South Jordan, UT (US)

( * ) Notice: Subject to any disclaimer, the term of this patent is extended or adjusted under 35 U.S.C. 154(b) by 841 days.

(21) Appl. No.: 13/217,107

(22) Filed: Aug. 24, 2011

(65) Prior Publication Data

US 2011/0303465 A1 Dec. 15, 2011

Related U.S. Application Data

(60) Continuation-in-part of application No. 12/561,936, filed on Sep. 17, 2009, now Pat. No. 8,146,686, which is a division of application No. 11/948,185, filed on Nov. 30, 2007, now Pat. No. 7,695,542.

(60) Provisional application No. 60/917,016, filed on May 9, 2007, provisional application No. 60/867,882, filed on Nov. 30, 2006.

(51) Int. Cl.
*E21B 10/48* (2006.01)
*B22F 5/00* (2006.01)

(52) U.S. Cl.
CPC ..... *E21B 10/48* (2013.01); *B22F 2005/001* (2013.01)

(58) Field of Classification Search
CPC ..... E21B 10/46
USPC ..... 175/406, 425, 434
See application file for complete search history.

(56) References Cited

U.S. PATENT DOCUMENTS 1,041,568 A 10/1912 Bade
1,939,991 A 12/1933 Krussell (Continued)

FOREIGN PATENT DOCUMENTS

AU 2007342231 A1 7/2008
AU 2011226849 A1 10/2011

(Continued)

OTHER PUBLICATIONS

International Search Report and the Written Opinion of the International Search Authority for Application No. PCT/US2012/044003 (mailed Mar. 19, 2013).

(Continued)

*Primary Examiner* — George Wyszomierski
*Assistant Examiner* — Ngoclan T Mai
(74) *Attorney, Agent, or Firm* — Ballard Spahr LLP

(57) ABSTRACT

Impregnated drilling tools include elongated structures that provide enhanced properties. The drilling tools contain a diamond-impregnated cutting section that contains elongated structures made from carbon, glass, ceramic, and the like. The elongated structures can comprise tubes, fibers, or rods. In one or more implementations the elongated structures are nano-sized. The elongated structures can control the tensile strength and/or the erosion rate of the drilling tools to optimize the cutting performance of the tools. Additionally, the elongated structures may also weaken the cutting section in one or more implementations; thereby, allowing higher strength binders to be used. Such higher modulus binders can cost less and allow for tailoring of the cutting section to retain the diamonds for the desired amount of time. As the cutting section erodes, the elongated structures may also increase the lubricity at the face of the cutting section.

20 Claims, 3 Drawing Sheets

(56) References Cited

U.S. PATENT DOCUMENTS

| | | | | |
|---|---|---|---|---|
| 2,147,843 | A | 2/1939 | Jamar et al. | |
| 2,326,908 | A | 8/1943 | Williams | |
| 2,371,488 | A | 3/1945 | Williams | |
| 2,495,400 | A | 1/1950 | Williams | |
| 2,552,485 | A | 5/1951 | Goepfert et al. | |
| 2,811,960 | A | 11/1957 | Fessel | |
| 3,215,215 | A | 11/1965 | Kellner | |
| 3,537,538 | A | 11/1970 | Generoux | |
| 3,972,161 | A | 8/1976 | Zoiss | |
| 4,128,136 | A | 12/1978 | Generoux | |
| 4,186,628 | A | 2/1980 | Bonnice | |
| 4,189,015 | A | 2/1980 | Acker, III et al. | |
| 4,190,126 | A * | 2/1980 | Kabashima | 175/426 |
| 4,208,154 | A | 6/1980 | Gundy | |
| 4,211,294 | A | 7/1980 | Multakh | |
| 4,452,325 | A | 6/1984 | Radd et al. | |
| 4,499,959 | A | 2/1985 | Grappendorf et al. | |
| 4,534,773 | A | 8/1985 | Phaal et al. | |
| 4,595,623 | A | 6/1986 | Du Pont et al. | |
| 4,613,287 | A | 9/1986 | Hambley | |
| 4,681,174 | A | 7/1987 | Aubakirov et al. | |
| 4,698,010 | A | 10/1987 | Toncelli | |
| 4,863,490 | A | 9/1989 | Buljan et al. | |
| 5,025,871 | A | 6/1991 | Stewart et al. | |
| 5,052,153 | A | 10/1991 | Wiand | |
| 5,069,584 | A | 12/1991 | Obermeier et al. | |
| 5,092,910 | A | 3/1992 | deKok et al. | |
| 5,218,888 | A | 6/1993 | Merrill | |
| 5,435,815 | A | 7/1995 | Ikegaya et al. | |
| 5,451,352 | A | 9/1995 | Cook | |
| 5,536,485 | A | 7/1996 | Kume et al. | |
| 5,644,956 | A | 7/1997 | Blackman et al. | |
| 5,677,372 | A | 10/1997 | Yamamoto et al. | |
| 5,901,964 | A | 5/1999 | Williams et al. | |
| 5,932,508 | A | 8/1999 | Armstrong et al. | |
| 5,996,571 | A | 12/1999 | Jedick | |
| 6,063,332 | A | 5/2000 | Imamura et al. | |
| 6,084,052 | A | 7/2000 | Aufdermarsh et al. | |
| 6,273,924 | B1 | 8/2001 | Krenkel et al. | |
| 6,390,890 | B1 | 5/2002 | Molnar | |
| 6,394,192 | B1 | 5/2002 | Frazer | |
| 6,399,737 | B1 | 6/2002 | Elkovitch | |
| 6,413,287 | B1 | 7/2002 | Barber, Jr. | |
| D466,139 | S | 11/2002 | Kim et al. | |
| 6,607,835 | B2 | 8/2003 | Fang et al. | |
| 6,997,977 | B2 | 2/2006 | Dallas et al. | |
| 7,141,086 | B2 | 11/2006 | Endoh et al. | |
| 7,243,745 | B2 | 7/2007 | Skeem et al. | |
| 7,641,004 | B2 | 1/2010 | Lapointe | |
| 7,695,542 | B2 * | 4/2010 | Drivdahl et al. | 75/229 |
| 7,975,785 | B2 | 7/2011 | Drivdahl et al. | |
| 8,016,056 | B2 * | 9/2011 | Viswanadham et al. | 175/374 |
| 8,146,686 | B2 * | 4/2012 | Drivdahl et al. | 175/332 |
| 8,191,445 | B2 | 6/2012 | Drivdahl et al. | |
| 8,783,384 | B2 | 7/2014 | Drivdahl et al. | |
| 2002/0020564 | A1 | 2/2002 | Fang et al. | |
| 2003/0162648 | A1 | 8/2003 | Middlemiss | |
| 2003/0236588 | A1 | 12/2003 | Jang et al. | |
| 2004/0231245 | A1 | 11/2004 | Yamamoto et al. | |
| 2005/0115743 | A1 | 6/2005 | Griffo | |
| 2005/0189647 | A1 | 9/2005 | Sung | |
| 2005/0247491 | A1 | 11/2005 | Mirchandani et al. | |
| 2006/0243494 | A1 | 11/2006 | Koltermann et al. | |
| 2007/0051455 | A1 | 3/2007 | Franchet et al. | |
| 2007/0131456 | A1 | 6/2007 | Lapointe | |
| 2008/0066969 | A1 | 3/2008 | Paul-Philippe | |
| 2008/0209818 | A1 * | 9/2008 | Belnap et al. | 51/307 |
| 2010/0089660 | A1 | 4/2010 | Pearce et al. | |
| 2011/0067924 | A1 | 3/2011 | Lambert et al. | |
| 2014/0013675 | A1 | 1/2014 | Tian et al. | |
| 2014/0231149 | A1 | 8/2014 | Drivdahl et al. | |
| 2014/0311809 | A1 | 10/2014 | Drivdahl et al. | |

FOREIGN PATENT DOCUMENTS

| | | | |
|---|---|---|---|
| AU | 2011226850 | A1 | 10/2011 |
| AU | 2012211429 | A1 | 8/2012 |
| AU | 2012211431 | A1 | 8/2012 |
| CA | 2671193 | A1 | 7/2008 |
| CN | 2521373 | Y | 11/2002 |
| EP | 2055890 | A1 | 5/2009 |
| JP | H03-243735 | A | 10/1991 |
| JP | 2003-243735 | A | 8/2003 |
| JP | 2004-358580 | A | 12/2004 |
| JP | 2006-255822 | A | 9/2006 |
| JP | 2006-257467 | A | 9/2006 |
| JP | 2006-257467 | A | 9/2006 |
| WO | WO-2006/076795 | A1 | 7/2006 |

OTHER PUBLICATIONS

Requirement for Restriction/Election issued on Sep. 9, 2008 for U.S. Appl. No. 11/948,185, filed Nov. 30, 2007 (Drivdahl; Boart Longyear) (8 pages).

Response to Restriction Requirement filed with the USPTO on Oct. 8, 2008 for U.S. Appl. No. 11/948,185, filed Nov. 30, 2007 (Drivdahl; Boart Longyear) (2 pages).

Non-Final Rejection issued on Jan. 26, 2009 for U.S. Appl. No. 11/948,185, filed Nov. 30, 2007 (Drivdahl; Boart Longyear) (6 pages).

Amendment and Response to Office Action filed with the USPTO on Apr. 23, 2009 for U.S. Appl. No. 11/948,185, filed Nov. 30, 2007 (Drivdahl; Boart Longyear) (12 pages).

Ex Parte Quayle Action issued on Aug. 18, 2009 for U.S. Appl. No. 11/948,185, filed Nov. 30, 2007 (Drivdahl; Boart Longyear) (7 pages).

Response to Ex Parte Quayle Action and Amendment filed with the USPTO on Sep. 17, 2009 for U.S. Appl. No. 11/948,185, filed Nov. 30, 2007 (Drivdahl; Boart Longyear) (6 pages).

Request for Continued Examination filed with the USPTO on Sep. 17, 2009 for U.S. Appl. No. 11/948,185, filed Nov. 30, 2007 (Drivdahl; Boart Longyear) (3 pages).

Non-Final Rejection issued on Oct. 5, 2009 for U.S. Appl. No. 11/948,185, filed Nov. 30, 2007 (Drivdahl; Boart Longyear) (6 pages).

Amendment and Response to Non-Final Office Action filed on Oct. 7, 2009 for U.S. Appl. No. 11/948,185, filed Nov. 30, 2007 (Drivdahl; Boart Longyear) (14 pages).

Notice of Allowance issued on Feb. 12, 2010 for U.S. Appl. No. 11/948,185, filed Nov. 30, 2007 (Drivdahl; Boart Longyear) (4 pages).

Issue Notification issued on Mar. 24, 2010 for U.S. Appl. No. 11/948,185, filed Nov. 30, 2007 (Drivdahl; Boart Longyear) (1 page).

Requirement for Restriction/Election issued on Aug. 3, 2009 for U.S. Appl. No. 12/276,903, filed Nov. 24, 2008 (Drivdahl; Boart Longyear) (9 pages).

Response to Restriction and Election of Species Requirement filed with the USPTO on Sep. 3, 2009 for U.S. Appl. No. 12/276,903, filed Nov. 24, 2008 (Drivdahl; Boart Longyear) (3 pages).

Non-Final Rejection issued on Sep. 24, 2009 for U.S. Appl. No. 12/276,903, filed Nov. 24, 2008 (Drivdahl; Boart Longyear) (9 pages).

Response to Non-Final Rejection filed with the USPTO on Nov. 23, 2009 for U.S. Appl. No. 12/276,903, filed Nov. 24, 2008 (Drivdahl; Boart Longyear) (12 pages).

Final Rejection issued on Jan. 19, 2010 for U.S. Appl. No. 12/276,903, filed Nov. 24, 2008 (Drivdahl; Boart Longyear) (9 pages).

Amendment and Response to Final Office Action filed with the USPTO on Apr. 14, 2010 for U.S. Appl. No. 12/276,903, filed Nov. 24, 2008 (Drivdahl; Boart Longyear) (10 pages).

Request for Continued Examination filed with the USPTO on Apr. 26, 2010 for U.S. Appl. No. 12/276,903, filed Nov. 24, 2008 (Drivdahl; Boart Longyear) (3 pages).

Final Rejection issued on Apr. 27, 2010 for U.S. Appl. No. 12/276,903, filed Nov. 24, 2008 (Drivdahl; Boart Longyear) (10 pages).

(56) References Cited

OTHER PUBLICATIONS

Amendment and Response to Final Office Action filed with the USPTO on Jul. 27, 2010 for U.S. Appl. No. 12/276,903, filed Nov. 24, 2008 (Drivdahl; Boart Longyear) (15 pages).
Request for Continued Examination filed with the USPTO on Jul. 27, 2010 for U.S. Appl. No. 12/276,903, filed Nov. 24, 2008 (Drivdahl; Boart Longyear) (3 pages).
Non-Final Rejection issued on Nov. 14, 2011 for U.S. Appl. No. 12/276,903, filed Nov. 24, 2008 [Drivdahl; Boart Longyear) (8 pages).
Amendment/Request for Reconsideration after Non-Final Rejection filed with the USPTO on Dec. 7, 2011 for U.S. Appl. No. 12/276,903, filed Nov. 24, 2008 (Drivdahl; Boart Longyear) (11 pages).
Notice of Allowance issued on Feb. 9, 2012 for U.S. Appl. No. 12/276,903, filed Nov. 24, 2008 (Drivdahl; Boart Longyear) (7 pages).
Issue Notification issued on May 16, 2012 for U.S. Appl. No. 12/276,903, filed Nov. 24, 2008 (Drivdahl; Boart Longyear) (1 page).
Non-Final Rejection issued on May 21, 2009 for U.S. Appl. No. 12/276,870, filed Nov. 24, 2008 (Drivdahl; Boart Longyear) (10 pages).
Amendment and Response to Office Action filed with the USPTO on Oct. 21, 2009 for U.S. Appl. No. 12/276,870, filed Nov. 24, 2008 (Drivdahl; Boart Longyear) (14 pages).
Final Rejection issued on Nov. 27, 2009 for U.S. Appl. No. 12/276,870, filed Nov. 24, 2008 (Drivdahl; Boart Longyear) (6 pages).
Amendment and Response to Final Office Action filed with the USPTO on Mar. 29, 2010 for U.S. Appl. No. 12/276,870, filed Nov. 24, 2008 (Drivdahl; Longyear) (12 pages).
Request for Continued Examination filed with the USPTO on Apr. 26, 2010 for U.S. Appl. No. 12/276,870, filed Nov. 24, 2008 (Drivdahl; Boart Longyear) (3 pages).
Non-Final Rejection issued on May 12, 2010 for U.S. Appl. No. 12/276,870, filed Nov. 24, 2008 (Drivdahl; Boart Longyear) (6 pages).
Amendment and Response to Office Action filed with the USPTO on Aug. 6, 2010 for U.S. Appl. No. 12/276,870, filed Nov. 24, 2008 (Drivdahl; Boart Longyear) (16 pages).
Non-Final Rejection issued on Oct. 19, 2010 for U.S. Appl. No. 12/276,870, filed Nov. 24, 2008 (Drivdahl; Boart Longyear) (8 pages).
Amendment and Response to Office Action filed with the USPTO on Feb. 12, 2011 for U.S. Appl. No. 12/276,870, filed Nov. 24, 2008 [Drivdahl; Boart Longyear) (14 pages).
Notice of Allowance issued on Mar. 7, 2011 for U.S. Appl. No. 12/276,870, filed Nov. 24, 2008 (Drivdahl; Boart Longyear) (7 pages).
Issue Notification issued on Jun. 22, 2011 for U.S. Appl. No. 12/276,870, filed Nov. 24, 2008 (Drivdahl; Boart Longyear) (1 page).
Non-Final Rejection issued on Nov. 14, 2011 for U.S. Appl. No. 12/561,936, filed Sep. 17, 2009 (Drivdahl; Boart Longyear) (10 pages).
Applicant-Initiated Interview Summary issued on Dec. 9, 2011 for U.S. Appl. No. 12/561,936, filed Sep. 17, 2009 (Drivdahl; Boart Longyear) (3 pages).
Notice of Allowance issued on Jan. 10, 2012 for U.S. Appl. No. 12/561,936, filed Sep. 17, 2009 (Drivdahl; Boart Longyear) (7 pages).
Issue Notification issued on Mar. 14, 2012 for U.S. Appl. No. 12/561,936, filed Sep. 17, 2009 (Drivdahl; Boart Longyear) (1 page).
Examiner's First Report issued on Oct. 21, 2010 for Australian Patent Application No. 2007342231, which was filed on Nov. 30, 2007 (Drivdahl; Boart Longyea) (3 pages).
Response to Examiner's First Report filed on Mar. 15, 2011 for Australian Patent Application No. 2007342231, which was filed on Nov. 30, 2007 (Drivdahl; Boart Longyear) (23 pages).
Examiner's Second Report issued on Mar. 21, 2011 for Australian Patent Application No. 2007342231, which was filed on Nov. 30, 2007 (Drivdahl; Boart Longyear) (2 pages).
Notice of Acceptance issued on Jun. 9, 2011 for Australian Patent Application No. 2007342231, which was filed on Nov. 30, 2007 (Drivdahl; Boart Longyear) (1 page).
Examiner's First Report issued on May 22, 2012 for Australian Patent Application No. 2011226850, which was filed on Nov. 30, 2007 (Drivdahl; Boart Longyear) (3 pages).
Examiner's First Report issued on May 21, 2012 for Australian Patent Application No. 2011226848, which was filed on Nov. 30, 2007 (Drivdahl; Boart Lonyear) (4 pages).
Examiner's First Report issued on May 7, 2012 for Australian Patent Application No. 2011226849, which was filed on Nov. 30, 2007 (Drivdahl; Boart Longyear) (3 pages).
Response to Examination Report filed on Aug. 8, 2012 for Australian Patent Application No. 2011226849, which was filed on Nov. 30, 2007 (Drivdahl; Boart Longyear) (13 pages).
Notice of Acceptance issued on Aug. 27, 2012 for Australian Patent Application No. 2011226849, which was filed on Nov. 30, 2007 (Drivdahl; Boart Longyear) (3 pages).
Letters Patent issued on Dec. 20, 2012 for Australian Patent Application No. 2011226849, which was filed on Nov. 30, 2007 (Drivdahl; Boart Longyear) (23 pages).
Examiner's First Report issued on Feb. 13, 2013 for Australian Patent Application No. 2012211429, which was filed on Aug. 8, 2012 (Drivdahl; Boart Longyear) (2 pages).
Examiner's First Report issued on Feb. 13, 2013 for Australian Patent Application No. 2012211431, which was filed on Aug. 8, 2012 (Drivdahl; Boart Longyear) (2 pages).
Office Action issued on Dec. 9, 2010 for Canadian Application No. 2,267,193, which was filed on Nov. 30, 2007 (Drivdahl; Boart Longyear) (2 pages).
Response to Office Action filed on Jun. 8, 2011 for Canadian Application No. 2,267,193, which was filed on Nov. 30, 2007 (Drivdahl; Boart Longyear) (10 pages).
Amendment filed on Jan. 27, 2012 for Canadian Application No. 2,267,193, which was filed on Nov. 30, 2007 (Drivdahl; Boart Longyear) (11 pages).
First Office Action issued on Sep. 21, 2011 for Chinese Patent Application No. 200780050729.8, which was filed on Nov. 30, 2007 (Drivdahl; Boart Longyear) (11 pages).
Response to Office Action filed on Dec. 23, 2011 for Chinese Patent Application No. 200780050729.8, which was filed on Nov. 30, 2007 (Drivdahl; Boart Longyear) (8 pages).
Second Office Action issued on Mar. 21, 2012 for Chinese Patent Application No. 200780050729.8, which was filed on Nov. 30, 2007 (Drivdahl; Boart Longyear) (13 pages).
Third Office Action issued on Jun. 3, 2012 for Chinese Patent Application No. 200780050729.8, which was filed on Nov. 30, 2007 (Drivdahl; Boart Longyear; (5 pages).
Response to Office Action filed on Jul. 3, 2012 for Chinese Patent Application No. 200780050729.8, which was filed on Nov. 30, 2007 (Drivdahl; Boart Longyear) (10 pages).
International Search Report and Written Opinion issued by the International Bureau on Aug. 5, 2008 for PCT/US2007/086156, which was filed on Nov. 30, 2007 and published as WO 2008085616 on Jul. 17, 2008 (Drivdahl; Boart Longyear) (14 pages).
Non-Final Office Action issued Apr. 8, 2013 for U.S. Appl. No. 13/477,989, filed May 22, 2012 and published as U.S. 2012/0228036 on Sep. 13, 2012 (Drivdahl; Boart Longyear) (8 Pages).
Applicant's Arguments and Remarks Made in an Amendment filed Jul. 8, 2013 for U.S. Appl. No. 13/477,989, filed May 22, 2012 and published as U.S. 2012/0228036 on Sep. 13, 2012 (Drivdahl; Boart Longyear) (3 Pages).
Amendment and Request for Reconsideration After Non-Final Office Action filed Jul. 8, 2013 for U.S. Appl. No. 13/477,989, filed May 22, 2012 and published as U.S. 2012/0228036 on Sep. 13, 2012 (Drivdahl; Boart Longyear) (1 Page).
Non-Final Office Action issued Oct. 23, 2013 for U.S. Appl. No. 13/477,989, filed May 22, 2012 and published as U.S. 2012/0228036 on Sep. 13, 2012 (Drivdahl; Boart Longyear) (7 Pages).
Applicant's Arguments and Remarks Made in an Amendment filed Jan. 23, 2014 for U.S. Appl. No. 13/477,989, filed May 22, 2012 and published as U.S. 2012/0228036 on Sep. 13, 2012 (Drivdahl; Boart Longyear) (2 Pages).

(56) References Cited

OTHER PUBLICATIONS

Amendment and Request for Reconsideration After Non-Final Office Action filed Jan. 23, 2014 for U.S. Appl. No. 13/477,989, filed May 22, 2012 and published as U.S. 2012/0228036 on Sep. 13, 2012 (Drivdahl; Boart Longyear) (1 Page).
Notice of Allowance issued Mar. 11, 2014 for U.S. Appl. No. 13/477,989, filed May 22, 2012 and published as U.S. 2012/0228036 on Sep. 13, 2012 (Drivdahl; Boart Longyear) (6 Pages).
International Search Report and Written Opinion of the International Searching Authority on Jul. 8, 2015 for application PCT/US2015/022965 filed on Mar. 27, 2015 (Longyear TM, Inc.//Drivdahl) (33 pages).
Office Action issued by the Canadian Intellectual Property Office on Apr. 16, 2015 for CA 2846022, filed on Jun. 25, 2012 (Boart Longyear//Rupp) (3 pages).
Office Action issued by the State Intellectual Property Office of the People's Republic of China on Feb. 27, 2015 for application CN 201280041225.0, filed on Jun. 25, 2012 (Boart Lonhyear//Rupp) (Translation—13 pages).
Extended European Search Report issued on Sep. 25, 2015 by the European Patent Office for application 12826384.5, filed on Jun. 25, 2012, and published as EP 2748403 on Jul. 2, 2014 (Longyear TM, Inc.//Rupp, et al.) (6 pages).
Extended European Search Report issued on Aug. 26, 2015 by the European Patent Office for European Patent Application No. 07865035.5, filed on Jun. 26, 2009 and published as EP 2092155 on Aug. 26, 2009 (Longyear TM, Inc.//Drivdahl et al.) (5 pages).
Beaton, T. and K. Johnson, (2000) "New Technology in Diamond Drill Bits Improves Performance in Variable Formations", IADC/SPE Drilling Conference, (7 pages).

* cited by examiner

IMPREGNATED DRILLING TOOLS INCLUDING ELONGATED STRUCTURES

CROSS-REFERENCE TO RELATED APPLICATIONS

This patent application is a continuation-in-part application of U.S. patent application Ser. No. 12/561,936, filed on Sep. 17, 2009, entitled "Fiber-Containing Sintered Drilling tools," which is a divisional of U.S. patent application Ser. No. 11/948,185, now U.S. Pat. No. 7,695,542, filed on Nov. 30, 2007, entitled "Fiber-Containing Diamond-Impregnated Drilling tools," which claims priority to and the benefit of U.S. Provisional Application Ser. No. 60/917,016, filed May 9, 2007, entitled "Fiber-Reinforced Diamond Wire," and U.S. Provisional Application Ser. No. 60/867,882, filed Nov. 30, 2006, entitled "Fiber-Reinforced Core Drill Bit." The contents of each of the above-referenced applications and patent are hereby incorporated by reference in their entirety.

BACKGROUND OF THE INVENTION

1. The Field of the Invention

This application relates generally to drilling tools and their methods of manufacture and use. In particular, this application relates to diamond-impregnated drilling tools that may contain elongated structures.

2. Discussion of the Relevant Art

Drill bits and other earth-boring tools are often used to drill holes in rock and other hard formations for exploration or other purposes. One type of drill bit used for such operations is an impregnated drill bit. The part of these tools that performs the drilling action (or the cutting section of the tool) is generally formed of a matrix that contains a powdered hard particulate material, such as tungsten carbide. This material is typically infiltrated with a binder, such as a copper alloy. Finally, the cutting section of these tools is typically impregnated with an abrasive cutting media, such as for example, natural or synthetic diamonds.

During drilling operations using an impregnated drill bit, the abrasive cutting media is gradually exposed as the supporting matrix material is worn away. The continuous exposure of new abrasive cutting media by wear of the supporting matrix forming the cutting section is a fundamental functional principle of impregnated drilling tools. Impregnated drilling tools may continue to cut efficiently until the cutting section of the tool is completely consumed. At that point, the tool becomes dull and must be replaced with another one.

In some cases, impregnated drilling tools may be expensive and their replacement may be time consuming, costly, as well as dangerous. For example, the replacement of a drill bit requires removing (or tripping out) the entire drill string from a hole that has been drilled (the borehole). Each section of the drill rod must be sequentially removed from the borehole. Once the drill bit is replaced, the entire drill string must be assembled section by section, and then tripped back into the borehole. Depending on the depth of the hole and the characteristics of the materials being drilled, this process may need to be repeated multiple times for a single borehole. Thus, one will appreciate that the more times a drill bit needs to be replaced, the greater the time and cost required to perform a drilling operation.

Furthermore, conventional impregnated drilling tools often have several characteristics that can add to the consumption rate of the cutting section, and therefore, increase the operating costs associated with those drilling tools. First, the binder materials in the tools may be relatively soft in comparison to the cutting media. Accordingly, the cutting section may erode and allow diamonds or other abrasive cutting media to slough off prematurely. Second, the erosion rate of the cutting section can be increased by insufficient lubrication to and around the cutting face of the tool, or the interface between the cutting section of the tool and the material being cut. An increased erosion rate can be due at least in part to the large amounts of friction and heat created at the drilling surface from the pressure and rotational speed associated with drilling operations. Third, conventional impregnated drilling tools may also be too wear resistant to expose and renew layers of the cutting section.

Accordingly, there are a number of disadvantages in conventional impregnated drilling tools that can be addressed.

BRIEF SUMMARY OF THE INVENTION

One or more implementations of the present invention overcome one or more problems in the art with impregnated drilling tools, systems, and methods including elongated structures that can be used to control the properties of the drilling tools. For example, according to one or more implementations the drilling tools contain an impregnated cutting section including elongated structures (e.g., fibers, tubes, rods). The elongated structures may be used to control the strength and/or the erosion rate of the matrix in the cutting section to optimize the cutting performance of the tools.

For example, an implementation of an impregnated drilling tool can include a cutting section including a matrix of a hard particulate material and a binder. The plurality of cutting media and a plurality of elongated structures can be dispersed within the matrix. The matrix can be adapted to erode and expose cutting media during drilling.

Additionally, a drill bit in accordance with an implementation of the present invention can include a shank and a cutting section. The cutting section can include a matrix of hard particulate material. A plurality of cutting media and a plurality of elongated structures can be dispersed within the matrix. The plurality of elongated structures can weaken the cutting section.

In addition to the foregoing, an impregnated core drill bit can include a shank and an annular cutting section. The annular cutting section can include a base and an opposing cutting face. The base of the cutting section can be secured to the shank. The annular cutting section can include a matrix of hard particulate material and a binder. A plurality of cutting media and a plurality of elongated structures can be dispersed within the matrix of the cutting section between the cutting face and the base. The matrix can be adapted to erode and expose abrasive cutting media and elongated structures positioned between the cutting face and the base during drilling.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. It should be noted that the figures are not drawn to scale, and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
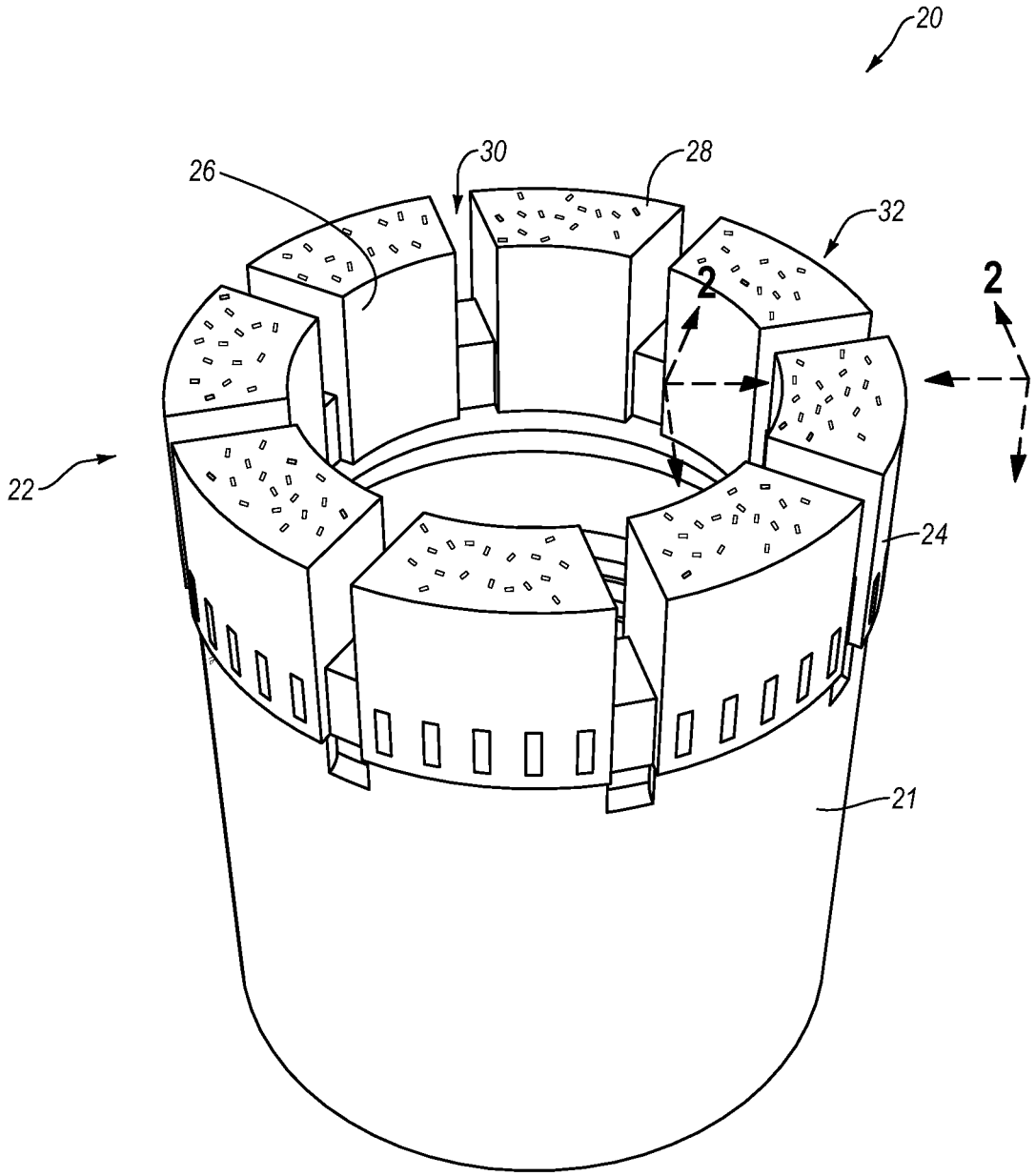
FIG. 1 illustrates a drilling tool with a cutting section including elongated structures in accordance with one or more implementations of the present invention.

One or more implementations of the present invention include impregnated drilling tools, systems, and methods including elongated structures that can be used to control the properties of the drilling tools. For example, according to one or more implementations the drilling tools contain an impregnated cutting section including elongated structures (e.g., fibers, tubes, rods). The elongated structures may be used to control the strength and/or the erosion rate of the matrix in the cutting section to optimize the cutting performance of the tools.

More particularly, impregnated drilling tools of one or more implementations can contain a matrix with a powdered metal or a hard particulate material, such as tungsten carbide or any other abrasive or super-abrasive material. This material can be infiltrated with a binder, such as a copper alloy. The cutting section of these tools can also be impregnated with diamonds, or some other form of abrasive cutting media, and mixed (and, in one or more implementations, reinforced) with elongated structures as described in greater detail below.

According to one or more implementations, the elongated structures can be used to tailor the properties of the cutting section of drilling tools to increase the drilling performance of the tools. For instance, the elongated structures can strengthen or weaken the cutting section. Furthermore, the elongated structures can be tailored to retain the abrasive cutting media in the cutting section for a desired amount of time, or to help ensure consistent erosion. Thus, one or more implementations of the present invention can allow for tailoring of a cutting section to increase life, increase performance, and/or include desirable properties for a particular formation to be drilled (e.g., hard formations, broken formations, soft formations).

Additionally, heat created by friction is one cause of the premature sloughing off of abrasive cutting media from an impregnated drilling tool. Heat created by friction can also cause the premature failure of an entire impregnated drilling tool. One or more implementations of the present invention can help overcome or mitigate problems related to heat and friction. For example, as the cutting section erodes, the elongated structures can increase the lubricity at the bit face of the cutting section, thereby cooling the bit face and reducing friction and associated heat.

In addition to the foregoing, impregnated drilling tools including elongated structures in accordance with one or more implementations can allow higher strength binders to be used. Such higher strength binders can cost less than traditional binders. Furthermore, higher strength binders can increase the transverse rupture strength, the tensile strength, and/or the hardness of the cutting section. Thus, elongated structures can allow the drilling tools to last longer and make them safer and more economical.

The drilling tools described herein can be used to cut stone, subterranean mineral formations, ceramics, asphalt, concrete, and other hard materials. These drilling tools may include, for example, drill bits, diamond blades, tuck pointers, crack chasers, reamers, stabilizers, and the like. For example, the drilling tools may be any type of earth-boring drill bit (i.e., core sampling drill bit, drag drill bit, roller cone bit, navi-drill, full hole drill, hole saw, hole opener, etc.), and so forth. The figures and corresponding text included hereafter illustrate examples of an impregnated, core sampling drill bit, and methods of forming and using such a drill bit for ease of description. One will appreciate in light of the disclosure herein; however, that the systems, methods, and apparatus of the present invention can be used with other drilling tools, such as those mentioned hereinabove.

Referring now to the Figures, FIG. 1 illustrates a perspective view of an impregnated, core-sampling drill bit 20 including elongated structures in accordance with an implementation of the present invention. As shown in FIG. 1, the drill bit 20 can contain a first section or shank portion 21 configured to connect the drill bit 20 to a component of a drill string (e.g., a coupling reamer, a drill rod). The drill bit 20 can also include a second section, cutting section, or crown 22. The cutting section 22 can cut material or a formation during drilling.

As shown by FIG. 1, in one or more implementations, the drill bit 20 can have a generally annular shape defined by an outer surface 24 and an inner surface 26. Thus, the drill bit 20 can define an interior space about its central axis for receiving a core sample. Accordingly, pieces of the material being drilled can pass through the interior space of the drill bit 20 and up through an attached drill string. The drill bit 20 may be any size, and therefore, may be used to collect core samples of any size. In one or more implementations, the drill bit 20 can have a diameter from about 3 inches to about 12 inches. In alternative implementations, the diameter can be larger than 12 inches or smaller than 3 inches. Along similar lines, in one or more implementations, the kerf of the drill bit 20 (i.e., the radius of the outer surface 24 minus the radius of the inner surface 26) may be from about ¼ of an inch to about 6 inches. In alternative implementations, the kerf may be larger than 6 inches or smaller than ¼ of an inch.

The shank portion 21 can include a threaded connection and/or other features to aid in attachment to a drill string component. By way of example and not limitation, the shank portion 21 may be formed from steel, another iron-based alloy, or any other material that exhibits acceptable physical properties.

The cutting section 22 of the core sampling drill bit 20 can be configured to cut or drill the desired materials during drilling processes. In particular, the cutting section 22 of the drill bit 20 can include a cutting face 28. The cutting face 28 can include waterways or spaces 30 which divide the cutting face 28 into cutting elements 32. The waterways 30 can allow a drilling fluid or other lubricants to flow across the cutting face 28 to help provide cooling during drilling.

The construction of the cutting section of an impregnated drilling tool can directly relate to its performance. As mentioned previously, the cutting section of an impregnated drilling tool typically contains diamonds and/or other hard materials distributed within a suitable supporting matrix. Metal-matrix composites are commonly used for the supporting matrix material. Metal-matrix materials usually include a hard particulate phase with a ductile metallic phase. The hard phase often consists of tungsten carbide and other refractory elements or ceramic compounds. Copper or other nonferrous alloys are typically used for the metallic binder phase. Common powder metallurgical methods, such as hot-pressing, sintering, and infiltration are used to form the components of the supporting material into a metal-matrix composite.

Figure 2:
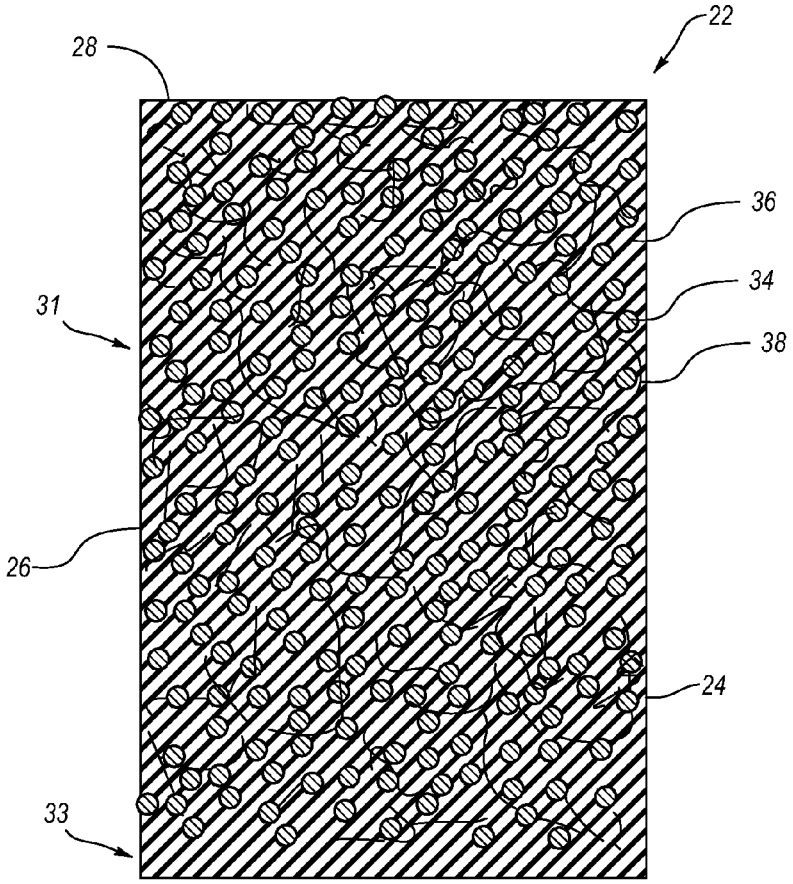
FIG. 2 illustrates an enlarged cross-sectional view of a cutting element of the drilling tool of FIG. 1 taken along the line 2-2 of FIG. 1.

For example, referring now to FIG. 2, an enlarged cross-sectional view the cutting section 22 of the drill bit 20 is shown. In one or more implementations, the cutting section 22 of the drill bit 20 can be made of one or more layers. For example, the cutting section 22 can include two layers. In particular, the cutting section 22 can include a matrix layer 31, which performs the cutting during drilling, and a backing layer or base 33, which connects the matrix layer 31 to the shank portion 21 of the drill bit 20.

FIG. 2 further illustrates that the cutting section or crown 22 of the drill bit 20 can comprise a matrix 36 of hard particulate material and a binder. The hard particulate material can comprise, for example, a metal. One will appreciate in light of the disclosure herein, that the hard particulate material may include a powered material, such as for example, a powered metal or alloy, as well as ceramic compounds. According to some implementations of the present invention the hard particulate material can include tungsten carbide. As used herein, the term "tungsten carbide" means any material composition that contains chemical compounds of tungsten and carbon, such as, for example, WC, W2C, and combinations of WC and W2C. Thus, tungsten carbide includes, for example, cast tungsten carbide, sintered tungsten carbide, and macrocrystalline tungsten. According to additional or alternative implementations of the present invention, the hard particulate material can include carbide, tungsten, iron, cobalt, and/or molybdenum and carbides, borides, alloys thereof, or any other suitable material.

As mentioned previously, the cutting section or crown 22 can also include a plurality of abrasive cutting media 34 dispersed throughout the matrix 36. The abrasive cutting media 34 can include one or more of natural diamonds, synthetic diamonds, polycrystalline diamond products (i.e., TSD or PCD), aluminum oxide, silicon carbide, silicon nitride, tungsten carbide, cubic boron nitride, alumina, seeded or unseeded sol-gel alumina, or other suitable materials.

The abrasive cutting media 34 used in the drill bit 22 can have any desired characteristic or combination of characteristics. For instance, the abrasive cutting media can be of any size, shape, grain, quality, grit, concentration, etc. In one or more implementations, the abrasive cutting media 34 can be very small and substantially round in order to leave a smooth finish on the material being cut by the core sampling drill bit 20. In alternative implementations, the cutting media 34 can be larger to cut aggressively into the material being cut.

The abrasive cutting media 34 can be dispersed homogeneously or heterogeneously throughout the cutting section 22. As well, the abrasive cutting media 34 can be aligned in a particular manner so that the drilling properties of the cutting media 34 are presented in an advantageous position with respect to the cutting section 22 of the drill bit 20. Similarly, the abrasive cutting media 34 can be contained in the 20 drill bit in a variety of densities as desired for a particular use. For example, large abrasive cutting media spaced further apart can cut material more quickly than small abrasive cutting media packed tightly together. But the size, density, and shape of the abrasive cutting media 34 can be provided in a variety of combinations depending on desired cost and performance of the drill bit 20.

In addition to abrasive cutting media 34, the cutting section 22 can include a plurality of elongated structures 38 dispersed throughout the matrix 36. The addition of elongated structures 38 can be used to tailor the properties of the cutting section 22 of the drill bit 20. For example, elongated structures 38 can be added to the matrix 36 material to interrupt crack propagation, and thus, increase the tensile strength and decrease the erosion rate of the matrix 36. Additionally, the addition of elongated structures 38 may also weaken the structure of the cutting section 22 by at least partially preventing the bonding and consolidation of some of the abrasive cutting media 34 and hard particulate material of the matrix 36.

As shown by FIG. 2, both the elongated structures 38 and the cutting media 34 can be dispersed within the matrix 36 between said cutting face 28 and said base 33. As an impregnated drilling tool, the matrix 36 can be configured to erode and expose cutting media 34 and elongated structures 38 initially located between the cutting face 28 and the base 33 during drilling. The continual expose of new cutting media 34 can help maintain a sharp cutting face 28.

Exposure of new elongated structures 38 can help reduce frictional heating of the drilling tool. For example, once the elongated structures 38 are released from the matrix 36 drilling they can provide cooling effects to the cutting face 28 to reduce friction and associated heat. Thus, the elongated structures 38 can allow for tailoring of the cutting section 22 to reduce friction and increase the lubrication at the interface between the cutting portion and the surface being cut, allowing easier drilling. This increased lubrication may also reduce the amount of drilling fluid additives (such as drilling muds, polymers, bentonites, etc.). that are needed, reducing the cost as well as the environmental impact that can be associated with using drilling tools.

The elongated structures 38 can be formed from carbon, metal (e.g., tungsten, tungsten carbide, iron, molybdenum, cobalt, or combinations thereof), glass, polymeric material (e.g., Kevlar), ceramic materials (e.g., silicon carbide), coated fibers, and/or the like. Furthermore, the elongated structures 38 can optionally be coated with one or more additional material(s) before being included in the drilling tool. Such coatings can be used for any performance-enhancing purpose. For example, a coating can be used to help retain elongated structures 38 in the drilling tool. In another example, a coating can be used to increase lubricity near the drilling face of a drilling tool as the coating erodes away and forms a fine particulate material that acts to reduce friction. In yet another example, a coating can act as an abrasive material and thereby be used to aid in the drilling process.

Any known material can be used to coat the elongated structures 38. For example, any desired metal, ceramic, polymer, glass, sizing, wetting agent, flux, or other substance could be used to coat the elongated structures 38. In one example, carbon elongated structures 38 are coated with a metal, such as iron, titanium, nickel, copper, molybdenum, lead, tungsten, aluminum, chromium, or combinations thereof. In another example, carbon elongated structures 38 can be coated with a ceramic material, such as SiC, SiO, SiO2, or the like.

Where elongated structures 38 are coated with one or more coatings, the coating material can cover any portion of the elongated structures 38 and can be of any desired thickness. Accordingly, a coating material can be applied to the elongated structures 38 in any manner known in the art. For example, the coating can be applied to elongated structures 38 through spraying, brushing, electroplating, immersion, physical vapor deposition, or chemical vapor deposition.

Additionally, the elongated structures 38 can also be of varying combination or types. Examples of the types of elongated structures 38 include chopped, milled, braided, woven, grouped, wound, or tows. In one or more implementations of the present invention, such as when the drilling tool comprises a core sampling drill bit 20, the elongated structures 38 can contain a mixture of chopped and milled fibers. In alternative implementations, the drilling tool can contain one type of elongated structure 38. In yet additional implementations, however, the drilling tool can contain multiple types of elongated structures 38. In such instances, where a drilling tool contains more than one type of elongated structures 38, any combination of type, quality, size, shape, grade, coating, and/or characteristic of elongated structures 38 can be used.

The elongated structures 38 can be found in any desired concentration in the drilling tool. For instance, the cutting section 22 of a drilling tool 20 can have a very high concentration of elongated structures 38, a very low concentration of fibers, or any concentration in between. In one or more implementations the drilling tool can contain elongated structures 38 ranging from about 0.1 to about 70% volume. Furthermore, a first portion of the drilling tool can have a first concentration of a particular type of elongated structure 38 and another portion can have a different concentration (either lower or higher) of the same or another type of elongated structure 38.

In one or more implementations, elongated structures 38 can be homogenously dispersed throughout the cutting section 22 of a drilling tool 20. In other implementations, however, the concentration of elongated structures 38 can vary throughout the cutting section 22 of a drilling tool 20, as desired. Indeed, any desired variation of the concentration of elongated structures 38 can be implemented in a drilling tool 20. For example, where the drilling tool comprises a core sampling drill bit 20, it can contain a gradient of fibers. In this example, the portion of the matrix layer that is closest to the cutting face 28 of the drill bit 20 can contain a first concentration of elongated structures 38 and the concentration of elongated structures 38 can gradually decrease or increase towards the shank portion 21. Such a drill bit can be used to drill a formation that begins with a soft, abrasive, unconsolidated formation, which gradually shifts to a hard, non-consolidated formation. Thus, the dispersal of the elongated structures 38 in the drill bit can be customized to the desired earth formation through which it will be drilling.

The concentration of elongated structures 38 can also vary in any desired manner in the drilling tool. In other words, a drilling tool can comprise sections, strips, spots, rings, or any other formation that contains a different concentration or mixture of elongated structures 38 than other parts of the drilling tool. For example, the cutting section 22 can comprise multiple layers, rings, or segments of matrix layer containing elongated structures 38. Each ring, layer, or segment of the drill bit can have a roughly homogenous (or heterogeneous) concentration of elongated structures 38 throughout the entire ring, layer or segment. Yet the concentration of elongated structures 38 can vary from ring to ring (or from segment to segment, etc.). Additionally, the various rings of differing elongated structures 38 gradients can be arranged in any order, can contain different elongated structures 38 or combinations of elongated structures 38, and can be of any desired thickness. In another implementation, the outer and inner surfaces of a drill bit could be provided with a different concentration of elongated structures 38 than the inner parts of the drill bit.

The elongated structures 38 can be located in the cutting section 22 of a drilling tool in any desired orientation or alignment. In one or more implementations, the elongated structures 38 can run roughly parallel to each other in any desired direction. FIG. 2 illustrates that, in other implementations, the elongated structures 38 can be randomly configured and can thereby be oriented in practically any or multiple directions relative to each other.

Figures 3A, 3B, 3C, 3D, 3E:
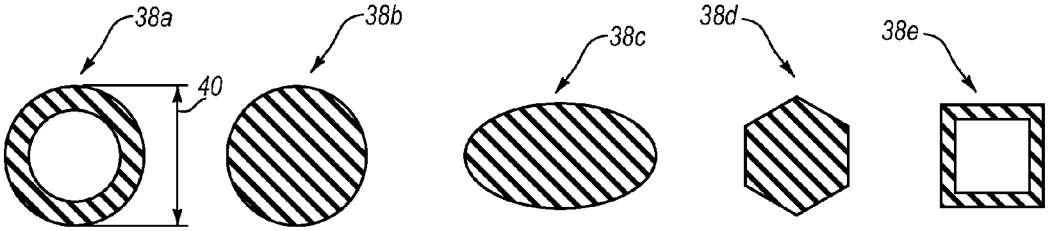
FIGS. 3A-3E illustrate cross-sectional view of various elongated structures in accordance with one or more implementations of the present invention.

The elongated structures 38 can comprise fibers, tubes, rods or other structures. For example, FIGS. 3A-3E illustrate cross-sectional views of various different types of elongated structures 38 of one or more implementations of the present invention. As illustrated by FIGS. 3A and 3E, in one or more implementations the elongated structures 38*a*, 38*e* can comprise tubes or other hollow structures. Such tubes 38*a*, 38*e* can include any shape or configuration. For example, FIG. 3A illustrates a tube 38*a* with a circular cross-section. While FIG. 3E illustrates a tube 38*e* with a square cross-section. In yet further implementations, the tubes can comprise rectangular, elliptical, hexagonal, or other shapes.

In alternative implementations, as shown by FIGS. 3B-3D, the elongated structures can comprise fibers or rods. In particular, the elongated structures 38 can comprise circular fibers 38*b*, elliptical fibers 38*c*, hexagonal fibers 38*d*, or rectangular, or fibers with other shapes. Thus, the elongated structures 38 may be of any shape or combination of shapes. The elongated structures 38 may be ribbon-like, cylindrical, polygonal, elliptical, straight, curved, curly, coiled, bent at angles, etc. For instance, FIG. 2 illustrates that in some embodiments, the majority of the elongated structures 38 may be curved. In other embodiments, such as when the drilling tool comprises a core sampling drill bit, the elongated structures 38 have a substantially cylindrical shape.

The elongated structures 38 in the cutting section 22 of a drilling tool, such as core sampling drill bit 20, can be of any size or combination of sizes, including mixtures of different sizes. For instance, elongated structures 38 can be of any length and have any desired diameter. In some embodiments, the elongated structures 38 can be nano-sized. In other words a diameter 40 of the elongated structures 38 can be between about 1 nanometer and about 100 nanometers. In alternative implementations, the elongated structures 38 can be micro-sized. In other words, diameter 40 of the elongated structures 38 can be between about 1 micrometer and about 100 micrometer. In yet additional implementations, the diameter 40 of the elongated structures 38 can be between about less than about 1 nanometer or greater than about 100 micrometers.

Additionally, the elongated structures 38 can have a length between about 1 nanometer and about 25 millimeters. In any event, the elongated structures 38 can have a length to diameter ratio between about 2 to 1 and about 500,000 to 1. More particularly, the elongated structures 38 can have a length to diameter ratio between about 10 to 1 and about 50 to 1.

As mentioned previously, the matrix 26 can comprise a hard particulate phase with a ductile metallic phase (i.e., binder). In particular, the abrasive cutting media 34, the elongated structures 38, and the hard particulate material can be infiltrated with a binder or as mentioned previously. The binder can comprise copper, zinc, silver, molybdenum, nickel, cobalt, tin, iron, aluminum, silicon, manganese, or mixtures and alloys thereof. Additionally, the copper-based infiltrant can include minor amount of various impurities or tramp elements, at least some of which, may necessarily be present due to manufacturing and handling processes. Such impurities can include, for example, aluminum, lead, nickel, tin, silicon, and phosphorous. The binder can bond the abrasive cutting media 34, elongated structures 38, and the hard particulate material together to form a cutting section 22.

According to one or more implementations of the present invention the binder material can include a copper-based infiltrant. For example, the weight % of copper in the copper-based infiltrant can be increased to further increase the cooling abilities of the final drilling tool as it erodes during drilling. Thus, according to some implementations of the present invention the copper-based infiltrant can include between about 85 weight % copper and about 98.5 weight % copper. According to some implementations of the present invention the copper-based infiltrant can include between about 90 weight % copper and about 95 weight % copper.

Additionally or alternatively to increasing the weight % of copper to increase the cooling abilities of the final drilling tool, the copper-based infiltrant of the present invention can include other thermally conductive metals, such as for example, silver, gold, or gallium (or mixtures thereof). For example, according to some implementations of the present invention, the copper-based infiltrant can include between about 0.5 to about 15 weight % silver, gold, or gallium. One will appreciate that the inclusion of silver, gold, or gallium can significantly raise the cost of the copper-based infiltrant.

The copper-based infiltrant of the present invention can be tailored to provide the drilling tools of the present invention with several different characteristic that can increase the useful life and/or the drilling efficient of the drilling tools. For example, the composition of the copper-based infiltrant can be controlled to vary the tensile strength and the erosion rate of the drilling tool. One will thus appreciate that the by modifying the composition of the copper-based infiltrant, the tensile strength and the erosion rate can be tailored to the amount needed for the particular end use of the drilling tool. This increased tensile strength can also increase the life of a drilling tool, allowing the cutting portion of the tools to wear at a desired pace and improving the rate at which the tool cuts. For example, a weight % of the iron and/or zinc in the binder can be increased to increase the strength of the final drilling tool.

Additionally, the composition of the copper-based infiltrant can be altered to strengthen the cutting portion of a drilling tool. For example, the weight percent of manganese and copper can be increased, and other materials with higher mechanical properties can be used to form the cutting portion of the drilling tools of the present invention. Thus, the cutting portion of the drilling tools of the present invention can be tailored to retain the diamonds in the cutting portion for the desired length of time.

According to some implementations of the present invention when the composition of the copper-based infiltrant is tailored to decrease its strength, the amount of elongated structures 38 can be adjusted to ensure that the cutting section erodes at a proper and consistent rate. In other words, the cutting portion can be configured to ensure that it erodes and exposes new abrasive cutting media during the drilling process. For example, the inventors of the present invention have discovered that the use of nanotubes as elongated structures allow for better infiltration. This in turn allows for the use of stronger binders that can further increase the life of an impregnated drilling tool.

In this way, the cutting section 22 of the drilling tool 20 may be custom-engineered to possess optimal characteristics for drilling specific materials. For example, a hard, abrasion resistant matrix may be made to drill soft, abrasive, unconsolidated formations, while a soft ductile matrix may be made to drill an extremely hard, non-abrasive, consolidated formation. Thus, the bit matrix hardness may be matched to particular formations, allowing the cutting section 22 to erode at a controlled, desired rate.

Larger fibers may impede infiltration. For example, in certain conditions roughly 9% addition by weight of carbon fibers can impede infiltration to a degree that does not allow for impregnated drill bits to be made. The inventors of the present invention have discovered that carbon nanotubes do not exhibit the same limitation. In particular, the size/scale of nanotubes does not alter the pore size in the matrix; thereby, thereby allowing infiltration of the binder into higher weight percentages.

Furthermore, the ability of nanotubes to control matrix erosion can be three or more times greater than larger fibers. Thus, a lower percentage of nanotubes can gain the same benefits as a higher percentage of fibers. For example, according to one or more implementations 1% addition by weight of nanotubes to a matrix can provide the same benefits as 3% addition by weight of fibers.

In addition to the foregoing, the mixing of fibers with or into a matrix can be a strong function of the stiffness and length of the fibers. Many commercially available fibers have a wide range of lengths. Such fibers may not mix well, or may require special mixing processes. Nanotubes, on the other hand, do cause any difficulties in mixing due to their smaller scale. Thus, nanotubes can provide unexpected results over some other types of elongated structures, such as micro-sized fibers.

In any event, implementations of the present invention allow for improved cutting sections of impregnated drilling tools. One will appreciate in light of the disclosure herein that the amounts of the various components of a cutting section of an impregnated drill tool can vary depending upon the desired properties. In one or more implementations, the hard particulate material can comprise between about 25% and about 85% by weight of the cutting section. More particularly, the hard particulate material can comprise between about 25% and about 60% by weight of the cutting section. For example, a cutting section of one or more implementations of the present invention can include between about 25% and 60% by weight of tungsten, between about 0% and about 4% by weight of silicon carbide, and between about 0% and about 4% by weight of tungsten carbide.

The elongated structures can comprise between about 0.1% and 25% by weight of the cutting section. More particularly, the elongated structures can comprises between about 1% and about 15% by weight of the cutting section. For example, a cutting section of one or more implementations of the present invention can include between about 3% and about 6% by weight of carbon nanotubes.

The cutting media can comprise between about 3% and about 25% by weight of the cutting section. More particularly, the cutting media can comprise between about 5% and 15% by weight of the cutting section. For example, a cutting section of one or more implementations of the present invention can include between about 5% and about 12.5%) by weight of diamond crystals.

The binder can comprise between about 15% and about 55% by weight of the cutting section. More particularly, the binder can comprise between about 20% and about 45% by weight of the cutting section. For example, a cutting section of one or more implementations of the present invention can include between about 20% and about 45% by weight of copper, between about 0% and about 5% by weight of nickel, between about 0% and about 20% by weight of silver, between about 0% and about 0.2% by weight of silicon, and between about 0% and about 21% by weight of zinc.

One will appreciate that the drilling tools with elongated structures according to implementations of the present invention can be used with almost any type of drilling system to perform various drilling operations. For example, FIG. 3, and the corresponding text, illustrate or describe one such drilling system with which drilling tools of the present invention can be used. One will appreciate, however, the drilling system shown and described in FIG. 4 is only one example of a system with which drilling tools of the present invention can be used.

Figure 4:
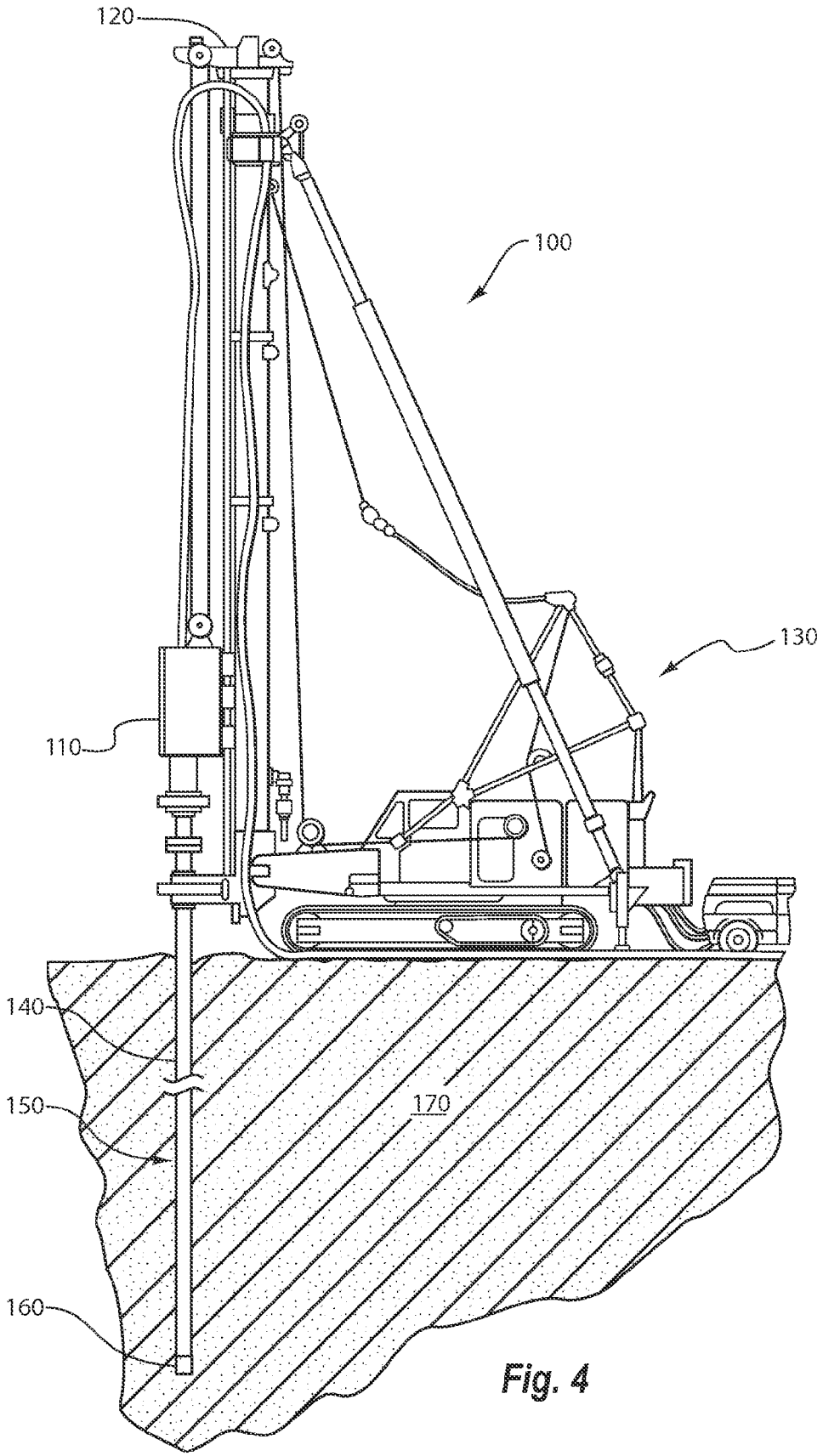
FIG. 4 illustrates a drilling system having a drilling tool with a cutting section including elongated structures in accordance with one or more implementations of the present invention.

For example, FIG. 4 illustrates a drilling system 100 that includes a drill head 110. The drill head 110 can be coupled to a mast 120 that in turn is coupled to a drill rig 130. The drill head 110 can be configured to have one or more tubular threaded member 140 coupled thereto. Tubular members can include, without limitation, drill rods, casings, and down-the-hole hammers. For ease of reference, the tubular members 140 will be described herein after as drill string components. The drill string component 140 can in turn be coupled to additional drill string components 140 to form a drill or tool string 150. In turn, the drill string 150 can be coupled to drilling tool 160, such as a rotary drill bit, impregnated, core sampling drill bit, or percussive bit, configured to interface with the material 170, or formation, to be drilled. According to some implementations of the present invention the drilling tool 160 can include a core-sampling drill bit 20, such as that depicted and described in relation to FIGS. 1 and 2.

In at least one example, the drill head 110 illustrated in FIG. 1 is configured rotate the drill string 150 during a drilling process. In particular, the drill head 110 can vary the speed at which the drill head 110 rotates. For instance, the rotational rate of the drill head and/or the torque the drill head 110 transmits to the drill string 150 can be selected as desired according to the drilling process.

Furthermore, the drilling machine can be configured to apply a generally longitudinal downward force to the drill string 150 to urge the drill bit 160 into the formation 170 during a drilling operation. For example, the drilling system 100 can include a chain-drive assembly that is configured to move the sled assembly relative to the mast 120 to apply the generally longitudinal force to the drill bit 160 as described above.

As used herein the term "longitudinal" means along the length of the drill string 150. Additionally, as used herein the terms "upper" and "above" and "lower" and "below" refer to longitudinal positions on the drill string 150. The terms "upper" and "above" refer to positions nearer the drill head 110 and "lower" and "below" refer to positions nearer the earth-boring tool 160.

Thus, one will appreciate in light of the disclosure herein, that the drilling tools of the present invention can be used for any purpose known in the art. For example, a diamond-impregnated core sampling drill bit can be attached to the end of the drill string 150, which is in turn connected to a drilling machine or rig 130. As the drill string 150 and therefore the drill bit 160 are rotated and pushed by the drilling machine 130, the drill bit 160 can grind away the materials in the subterranean formations 170 that are being drilled. The core samples that are drilled away can be withdrawn from the drill string 150. The cutting portion of the drill bit 160 can erode over time because of the grinding action. This process can continue until the cutting portion of a drill bit 160 has been consumed and the drilling string 150 need be tripped out of the borehole and the drill bit 160 replaced. One will appreciate, however, that the useful life of the drill bit 160 can be increased due to the consistent wear, increased cooling, and/or other advantages provided by the elongated structures of the present invention.

Implementations of the present invention also include methods of forming impregnated drill bits including elongated structures. The following describes at least one method of forming drilling tools having elongated structures. Of course, as a preliminary matter, one of ordinary skill in the art will recognize that the methods explained in detail can be modified to install a wide variety of configurations using one or more components of the present invention.

As an initial matter, the term "infiltration" or "infiltrating" as used herein involves melting a binder material and causing the molten binder to penetrate into and fill the spaces or pores of a matrix. Upon cooling, the binder can solidify, binding the particles of the matrix together. The term "sintering" as used herein means the removal of at least a portion of the pores between the particles (which can be accompanied by shrinkage) combined with coalescence and bonding between adjacent particles.

For example, a method of forming an impregnated drill bit 20 can comprise an act of preparing a matrix 36. In particular, the method can involve preparing a matrix of hard particulate material. For example, the method can comprise preparing a matrix of a powered material, such as for example tungsten carbide. In additional implementations, the matrix can comprise one or more of the previously described hard particulate materials. In some implementations of the present invention, the method can include placing the matrix in a mold.

The mold can be formed from a material that is able to withstand the heat to which the matrix 36 will be subjected to during a heating process. In at least one implementation, the mold may be formed from carbon or graphite. The mold can be shaped to form a drill bit having desired features. In at least one implementation of the present invention, the mold can correspond to a core drill bit.

In addition, the method can comprise an act of dispersing a plurality of relatively cutting media 34 throughout at least a portion the matrix. For example, the method can involve dispersing a plurality of abrasive cutting media 34 throughout at least a portion of the matrix 36. Additionally, the method can involve dispersing the abrasive cutting media 34 randomly or in an unorganized arrangement throughout the matrix 36.

In one or more further implementations, the method can further include dispersing a plurality of elongated structures 38 throughout at least a portion of the matrix 36. In particular, the method can include dispersing carbon nanotubes randomly or in an unorganized arrangement throughout the matrix 36.

The method can comprise an act of infiltrating the matrix 36 with a binder. This can involve heating the binder to a molten state and infiltrating the matrix with the molten binder. For example, in some implementations the binder can be placed proximate the matrix 36 and the matrix 36 and the binder can be heated to a temperature sufficient to bring the binder to a molten state. At which point the molten binder can infiltrate the matrix 36. In one or more implementations, the method can include heating the matrix 36, cutting media 34, elongated structures 38, and the binder to a temperature of at least 787° F. The binder can cool thereby bonding to the matrix 36, cutting media 34, elongated structures 38, together. According to some implementations of the present invention, the time and/or temperature of the infiltration process can be increased to allow the binder to fill-up a greater number and greater amount of the pores of the matrix. This can both reduce the shrinkage during infiltration, and increase the strength of the resulting drilling tool.

Additionally, that the method can comprise an act of securing a shank 21 to the cutting section 22. For example, the method can include placing a shank 21 in contact with the matrix 36. A backing layer 33 of additional matrix, binder material, and/or flux may then be added and placed in contact with the matrix 36 as well as the shank 21 to complete initial preparation of a green drill bit. Once the green drill bit has been formed, it can be placed in a furnace to thereby consolidate the drill bit. Alternatively, the first and second sections can be mated in a secondary process such as by brazing, welding, or adhesive bonding. Thereafter, the drill bit can be finished through machine processes as desired.

Before, after, or in tandem with the infiltration of the matrix 36, one or more methods of the present invention can include sintering the matrix 36 to a desired density. As sintering involves densification and removal of porosity within a structure, the structure being sintered can shrink during the sintering process. A structure can experience linear shrinkage of between 1% and 40% during sintering. As a result, it may be desirable to consider and account for dimensional shrinkage when designing tooling (molds, dies, etc.) or machining features in structures that are less than fully sintered.

The described elongated structures can give diamond-impregnated drilling tools several added advantages when compared to conventional drilling tools that lack elongated structures. First, the addition of the elongated structures can control the tensile strength and the erosion rate of the drilling tool, whether to strengthen or weaken these properties. Without being restricted to this understanding, it is believed that the presence of the elongated structures can be used to modify the number of defects in the cutting section of the tools. And since the tensile strength and erosion rate depend on the number of defects, modifying the amount of the elongated structures can be used to tailor the tensile strength and the erosion rate to the amount needed for the particular end use of the drilling tool. This increased tensile strength can also increase the life of a drilling tool, allowing the cutting section of the tools to wear at a desired pace and improving the rate at which the tool cuts.

Second, the addition of elongated structures may also weaken the structure of the cutting section and allow higher strength binders to be used for the drilling tools, but at a lower cost. Thus, the amount of elongated structures in the cutting section can be tailored to retain the diamonds in the cutting section for the desired length of time.

A third advantage is that the elongated structures may also act as abrasive cutting media that aid in the cutting process. A fourth advantage is that as the elongated structures in the cutting section erode away, their fine particulate matter can reduce friction and increase the lubrication at the interface between the cutting section and the surface being cut, allowing easier cutting.

The present invention can thus be embodied in other specific forms without departing from its spirit or essential characteristics. For example, the impregnated drill bits of one or more implementations of the present invention can include one or more enclosed fluid slots, such as the enclosed fluid slots described in U.S. patent application Ser. No. 11/610,680, filed Dec. 14, 2006, entitled "Core Drill Bit with Extended Crown Longitudinal dimension," now U.S. Pat. No. 7,628,228, the content of which is hereby incorporated herein by reference in its entirety. Still further, the impregnated drill bits of one or more implementations of the present invention can include one or more tapered waterways, such as the tapered waterways described in U.S. patent application Ser. No. 12/638,229, filed Dec. 15, 2009, entitled "Drill Bits With Axially-Tapered Waterways," the content of which is hereby incorporated herein by reference in its entirety. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. An impregnated drilling tool, comprising:
a cutting section comprising:
a matrix comprising a hard particulate material;
a plurality of cutting media dispersed within the matrix; and
a plurality of elongated structures dispersed within the matrix, wherein the plurality of elongated structures is configured to at least partially prevent the bonding and consolidation of some of the hard particulate material and of the cutting media, wherein the matrix is adapted to erode and expose cutting media during drilling.

2. The tool as recited in claim 1, wherein elongated structures of the plurality of elongated structures have a diameter between about 1 nanometer and about 100nanometers.

3. The tool as recited in claim 2, wherein elongated structures of the plurality of elongated structures comprise tubes.

4. The tool as recited in claim 3, wherein the tubes comprise carbon.

5. The tool as recited in claim 2, wherein elongated structures of the plurality of elongated structures have a length of between about 1 microns and about 500microns.

6. The tool as recited in claim 1, wherein the drilling tool comprises a coring drill bit.

7. The tool as recited in claim 1, wherein the drilling tool comprises a reamer.

8. The tool as recited in claim 1, wherein the plurality of cutting media comprises diamond crystals.

9. The tool as recited in claim 1, wherein the plurality of elongated structures are randomly dispersed within the matrix.

10. A drill bit, comprising:
a shank; and
a cutting section, the cutting section comprising:
a matrix of hard particulate material;
a plurality of cutting media dispersed within the matrix; and
a plurality of elongated structures dispersed within the matrix, wherein the plurality of elongated structures is configured to at least partially prevent the bonding and consolidation of some of the hard particulate material and of the cutting media, wherein the plurality of elongated structures weaken the cutting section.

11. The drill bit as recited in claim 10, wherein the elongated structures of the plurality of elongated structures have a length to diameter ratio between about 10 to 1 and about 500,000 to 1.

12. The drill bit as recited in claim 11, wherein the elongated structures of the plurality of elongated structures have a diameter between about 1 and about 100 nanometers.

13. The drill bit as recited in claim 12, wherein the elongated structures of the plurality of elongated structures comprise carbon.

14. The drill bit as recited in claim 13, wherein the elongated structures of the plurality of elongated structures comprise tubes.

15. An impregnated core drill bit, comprising:

a shank;

an annular cutting section including a base and an opposing cutting face, the base being secured to the shank, and the annular cutting section comprising a matrix of hard particulate material and a binder;

a plurality of cutting media dispersed within the matrix of s the aid cutting section between the cutting face and the base; and a plurality of elongated structures dispersed within the matrix of the cutting section between the cutting face and the base;

wherein the plurality of elongated structures is configured to at least partially prevent the bonding and consolidation of some of the hard particulate material and of the cutting media, and wherein the matrix of the cutting section is adapted to erode and expose cutting media and elongated structures positioned between the cutting face and the base during drilling.

16. The drill bit as recited in claim 15, wherein elongated structures of the plurality of elongated structures comprise nanotubes.

17. The drill bit as recited in claim 16, wherein the nanotubes are carbon.

18. The drill bit as recited in claim 17, wherein elongated structures of the plurality of elongated structures are dispersed in the matrix randomly relative to other elongated structures of the plurality of elongated structures.

19. The drill bit as recited in claim 17, wherein the plurality of elongated structures comprises between about 1% and about 15% by weight of the cutting section.

20. The drill bit as recited in claim 19, wherein the plurality of elongated structures comprises about 3% by weight of the cutting section.

* * * * *